United States Patent [19]

Sakurai et al.

[11] 4,443,328

[45] Apr. 17, 1984

[54] METHOD FOR CONTINUOUS THERMAL CRACKING OF HEAVY PETROLEUM OIL

[75] Inventors: Masao Sakurai, Mitaka; Tetsuo Wada, Ohmuta, both of Japan

[73] Assignees: Toyo Engineering Corporation; Mitsui Coke Co., Ltd., both of Japan

[21] Appl. No.: 384,000

[22] Filed: Jun. 1, 1982

[51] Int. Cl.[3] ..... C10G 9/16; C10G 9/00

[52] U.S. Cl. ..... 208/106; 208/40; 208/48 R; 208/48 Q

[58] Field of Search ..... 208/40, 106, 128, 129, 208/130, 131

[56] References Cited

U.S. PATENT DOCUMENTS

| | | | |
|---|---|---|---|
| 1,598,136 | 8/1926 | Herthel | 208/106 |
| 1,681,321 | 8/1928 | Brandt | 208/131 |
| 1,877,060 | 9/1932 | Schonberg | 208/106 |
| 2,366,057 | 12/1944 | Russell | 208/106 |
| 4,085,034 | 4/1978 | Endo et al. | 208/48 R |
| 4,136,015 | 1/1979 | Kamm et al. | 208/129 |
| 4,247,387 | 1/1981 | Akbar | 208/106 |

FOREIGN PATENT DOCUMENTS

| | | | |
|---|---|---|---|
| 253094 | 3/1967 | Austria | 208/129 |

*Primary Examiner*—Delbert E. Gantz
*Assistant Examiner*—O. Chaudhuri
*Attorney, Agent, or Firm*—McGlew and Tuttle

[57] ABSTRACT

Disclosed herein is an improved method for continuous thermal cracking of heavy petroleum oil, which can achieve a high degree of cracking in a column-like reactor of relatively small size and provides residual pitch rich in $\beta$-resin components and lean in gas mixed therein. The above method comprises charging preheated heavy oil into an upper reaction zone of an upright cylindrical continuous reactor, which is divided into upper and lower reaction zones by means of a partition plate, drawing the resultant cracked gas and oil vapor from the upper reaction zone, and discharging residual pitch through the bottom of the lower reaction zone. Also disclosed are a first improvement to the above thermal cracking method through the provision of a cooling chamber and a defoaming chamber adjacent to the lowermost portion of the reactor so as to respectively terminate the reaction and subject the resultant pitch to defoaming, and another improvement through the provision of a rotary scraper in the reactor, which scraper has blades contiguous to their corresponding reactor walls or partition plates.

7 Claims, 4 Drawing Figures

METHOD FOR CONTINUOUS THERMAL CRACKING OF HEAVY PETROLEUM OIL

BACKGROUND OF THE INVENTION (1) Field of the Invention:

This invention relates to a method for continuous thermal cracking of heavy petroleum oil. More particularly, it relates to a method for continuous thermal cracking of heavy petroleum oil, which comprises charging the heavy petroleum oil into the upper reaction zone of an upright cylindrical reactor, which is divided into upper and lower reaction zones, and discharging the resultant cracked gas and cracked oil vapor and the resulting residual pitch, respectively, from the upper and from the lower reaction zones. This invention also relates to a first embodiment of the method for continuous thermal cracking of heavy petroleum oil in which, upon obtaining a residual pitch the reaction liquid leaving the reactor is introduced into a cooling chamber and a defoaming chamber so as to cool the reaction liquid, thereby terminating the reaction, and to defoam the resultant pitch; the invention also relates to a second embodiment of the above method in which the upright cylindrical reactor is provided with a rotary scraper having blades which are contiguous to their corresponding reactor walls or partition plates.

(2) Description of the Prior Art:

With a view toward making an effective use of heavy petroleum oil, a wide variety of attempts has heretofore been made to obtain gas, cracked light oil and pitch from such heavy petroleum oil by thermal cracking.

It is extremely important for an effective use of heavy petroleum oil, for savings in usable coal and for employing a wide choice of usable coals to utilize pitch produced from heavy petroleum oil as a binder in making coke for steel-making blast furnace or as a substitute for caking coal which is also used to make such coke. Needless to say, it is also very important to improve the yield of light oil to be obtained by cracking.

In order to make pitch obtained through the thermal cracking of heavy petroleum oil suitable in quality for the above applications, it is necessary that such pitch has a composition rich in components insoluble in benzene and lean in components insoluble in quinoline, in other words; a composition rich in $\beta$-resin components which have an average degree of carbonization and polycondensation.

A variety of batch and continuous methods for cracking of heavy petroleum oil are known. However, it is difficult to obtain pitch suitable in quality for the above applications in accordance with any such conventional methods. The present applicants have already proposed to conduct the thermal cracking of heavy petroleum oil by causing the heavy petroleum oil to flow upwardly through a reactor equipped with at least one partition plate defining an opening at the center thereof while controlling its residence time within 1–10 hours (Japanese Patent Application No. 3921/1981). Generally speaking, a reaction for thermal cracking of heavy petroleum oil induces a violent formation of bubbles at the beginning of the reaction due to cracked gas and cracked oil vapor. Since the reaction liquid is caused to flow upwardly in the above method, bubbles tend to occur in large volume in the lower part of the reactor, whereby requiring a column-like reactor of large volume. In addition, it is necessary to divide such reactor by means of a fairly large number of partition plates in order to render the quality of the resulting pitch suitable for the above-mentioned applications. This is because the reaction liquid is subjected to vigorous stirring by the rising flow of gas bubbles and the nearly through mixing with the gas.

This invention contemplates to provide an improved method for thermal cracking of heavy petroleum oil, which can achieve a high degree of cracking and, at the same time, produce as a byproduct a residual pitch rich in $\beta$-resin components.

In one aspect of this invention, there is thus provided a method for the continuous thermal cracking of heavy petroleum oil which comprises continuously charging preheated heavy petroleum oil into the upper reaction zone of an upright cylindrical reactor, which is divided into an upper and a lower reaction zone by means of a partition plate defining an opening therethrough, so as to subject said preheated heavy petroleum oil to a thermal cracking reaction; drawing the resultant cracked gas and oil vapor from the upper reaction zone; causing the resultant reaction liquid to travel from the upper reaction zone through the lower reaction zone without back-mixing; allowing a small amount of cracked gas and cracked oil vapor, which have been formed in the course of the downward travelling of the resultant reaction liquid through the lower reaction zone, to rise through the lower reaction zone and be withdrawn from the reactor through the upper reaction zone; and discharging residual pitch through the bottom of the lower reaction zone.

Although the above method can certainly achieve its objects as far as its thermal cracking aspect is concerned, it still has some problems to be solved, including how the reaction solution should be cooled to terminate the cracking reaction.

Cooling a high temperature reaction liquid, in which a reaction is proceeding, so as to terminate the reaction, is generally effected by passing the reaction liquid through a cooling apparatus equipped with heat-exchanging surfaces and subjecting it to heat exchange with a cooling medium. Where a high temperature liquid is a substance having an extremely high viscosity and being susceptible of causing coking, such as a liquid under reaction in a thermal cracking reaction of heavy petroleum oil, a heat exchange cooling method is not practical because its heat-transfer coefficient is small and plugging tend to occur due to coking.

When pitch has been cooled down in accordance with such a cooling method as mentioned above, it contains not only gas bubbles dispersed and entrained therein but also gases dissolved therein and oils having low boiling points. When the thus-cooled pitch is pumped out of the cooling apparatus a vapor lock phenomenon is induced which renders its smooth discharge difficult.

In the second aspect of this invention, there is provided a method for continuous thermal cracking of heavy petroleum oil, which allows to conduct the cooling of the reaction liquid, in which the reaction has been brought to termination, without need for any heat-exchanging surfaces while at the same time obviating the occurrence of coking and also permitting an easy discharge of the resultant residual pitch by means of a pump.

As a continuous column-like thermal cracking apparatus a soaking drum of a visbreaker is used. In this case, the percentage of cracking is held low, i.e., 15–30% or lower for each raw material in order to keep the stability of the visbroken oil high. Thus, the progress of coking is extremely slow and, even if the soaking drum is provided with internal partition plates, it is not furnished with any scraper. The cleaning of the interior of the soaking drum is generally carried out periodically.

Where thermal cracking is effected with a longer residence time than that for cracking in a visbreaker and under such reaction conditions that a high degree of cracking is sought, a violent coke formation takes place on the inner wall of the reactor, whereby a long run operation of the reactor becomes impossible. Accordingly, in thermal cracking of heavy petroleum oil with a high degree of cracking, it is preferred to avoid the formation and sticking of coke on the inner wall and on the partition plates of the reactor.

In a third aspect of this invention, there is provided a method for continuous thermal cracking of heavy petroleum oil in which a preheated feed stream of heavy petroleum oil is introduced continuously into the upper reaction zone of a column-like reactor, cracked gas and oil vapor are drawn out of the reactor through an upper portion thereof and residual pitch is discharged through a bottom portion of the reactor. The method is characterized in that the reactor is provided with a rotary scraper having blades which are contiguous to their corresponding reactor walls or partition plates.

SUMMARY OF THE INVENTION

An object of this invention is to provide a method for continuous thermal cracking of heavy petroleum oil, which method achieves a high degree of thermal cracking and, at the same time, yields a readily discharged residual pitch containing $\beta$-resin in a high concentration.

Another object of this invention is to provide a method for continuous thermal cracking of heavy petroleum oil, which comprises charging a nonreactive cooling medium directly into a reaction liquid, in which the thermal cracking reaction has proceeded to a predetermined extent, to terminate the reaction and subjecting the resultant reaction liquid to defoaming in a defoaming chamber.

A further object of this invention is to provide a method for continuous thermal cracking method of heavy petroleum oil, in which a column-like reactor is provided therein with a rotary scraper having blades which are contiguous to their corresponding reactor walls or partition plates, thus permitting a continuous steady operation over a long period of time.

DETAILED DESCRIPTION OF THE INVENTION

Figure 1:
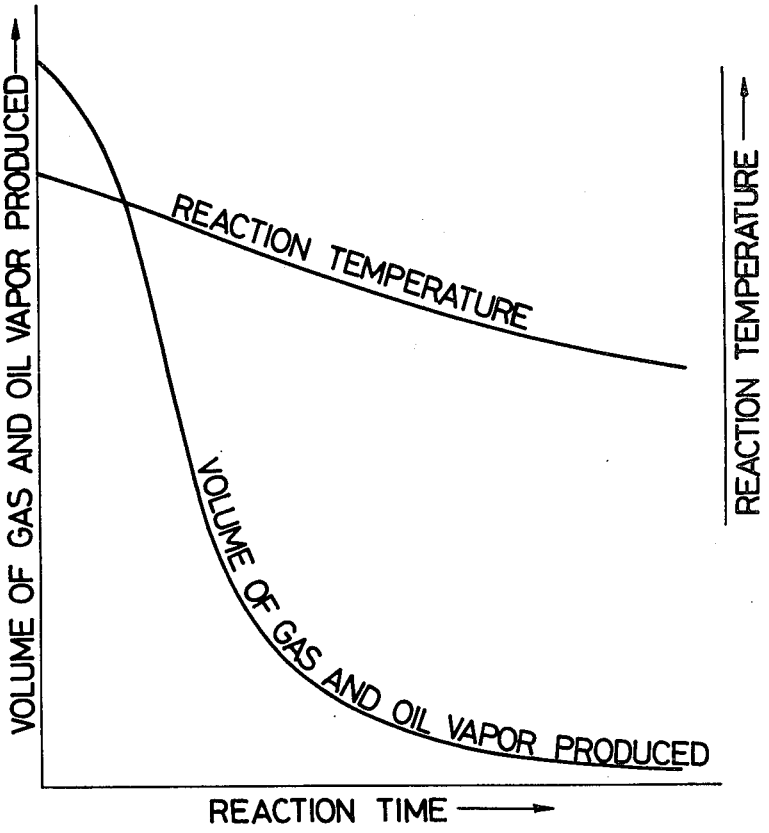
FIG. 1 is a diagrammatic illustration showing the relationship between the reaction time and the volume of gas and oil vapor produced as well as the relationship between the reaction time and the reaction temperature, both, in the thermal cracking of heavy petroleum oil.

The present invention makes use of the characteristic feature of a method for thermal cracking of heavy petroleum oil, namely, of the fact that, as illustrated in FIG. 1, the reaction forming cracked gas and cracked oil vapor proceeds predominantly in an initial stage while the formation of $\beta$-resin from byproduct pitch takes place principally in a later stage of the thermal cracking reaction. The initial reaction is, as described above, carried out in the upper reaction zone while generating cracked gas and cracked oil vapor, thereby completing a major part of the thermal cracking reaction. The resultant reaction liquid, which has left the upper reaction zone, is caused to flow downwardly without back-mixing through the aforementioned lower reaction zone, during which the $\beta$-resin-forming reaction occurs with some further thermal cracking taking place to a slight extent. The cracked gas and cracked oil vapor produced through the thermal cracking reaction in the lower reaction zone rise through the reaction liquid and are withdrawn from the upper reaction zone.

The lower reaction zone may be divided into 2 or more sections by means of one or more partition plates, each, defining a circular opening or slit therethrough.

An embodiment of this invention will hereinafter be described with reference to FIG. 2. A feed of heavy petroleum oil is charged through a line 1 into a heating furnace 2, where it is preheated, preferably, to a temperature of 400°–510° C. The thus-preheated heavy petroleum oil is then introduced via a line 3 into an upper reaction zone 5 of a column-like reactor 4 in which a stirrer 8 is provided. The upper reaction zone 5 is connected with a lower reaction zone 6 and a partition wall 7 is interposed therebetween. Stripping steam for cracked oil may be blown into the upper reaction zone 5 if necessary. The lower reaction zone 6 is divided into 4 sections by partition plates 7', 7'', 7''' which are individually similar to the partition wall 7. Needless to say, no particular limitation exists to the number of such partition plates so long as there is at least one. However, a number exceeding 20 may be impractical because so many partition plates make the height of each section too low. Each of these partition wall and plates 7, 7', 7'', 7''' defines an opening such as a circular opening or slit. The diameter of each circular opening or the width of each slit may preferably be 5 mm or greater, because diameters or widths smaller than 5 mm impede the downward flow of the reaction liquid. The area of each opening is preferably 20% or less of the horizontal cross-sectional area of the reactor, and notably 10% or less. If the percentage of the opening exceeds 20%, intermixing of the reaction liquids in any two adjacent sections becomes greater. The percentage of the opening may be made smaller as the liquids descend keeping the openings, of course, within the above range. Incidentally, it is perferable to make the volume ratio of the upper reaction zone to the lower reaction zone 0.5 or smaller. Otherwise, the prevention of back-mixing cannot be achieved to a sufficient extent.

The heavy petroleum oil introduced into the upper reaction zone 5 undergoes a major part of its thermal cracking there. A great quantity of gas and oil vapor is generated as the reaction proceeds. They are withdrawn from the reaction system through a line 9.

The reaction liquid then passes through the opening of the partition plate 7 and enters into the lower reaction zone 6, where it flows downwardly through the openings of each of the partition plates 7', 7'', 7''' practically without back-mixing. While it travels through the lower reaction zone 6, polymerization reactions occur in the reaction liquid phase, resulting in the formation of β-resin components and quinoline-insoluble components. The cracked gas and cracked oil vapor formed in the lower reaction zone 6 are small in quantity and rise in the form of bubbles countercurrently to the flow of the reaction liquid. They are eventually removed through the line 9, together with gases produced in the upper reaction zone 5. Although it is desirous to increase the openings of each partition plate or wall so as to permit a smooth downward flow of the reaction liquid through the lower reaction zone 6 against rising gas bubbles, it is undesirable to have too many openings because the reaction liquid becomes intermixed across each partition plate or wall. According to study results obtained by the present inventors, the above mutually contradictory requirements can be fulfilled by making the area of the openings in each plate 20% or less of the horizontal cross-sectional area of the column-like reactor and controlling the flow rate of the cracked gas and cracked oil vapor within a range of 1–10 m/sec at the opening of each partition wall or plate. If the flow rate exceeds the upper limit of the range, the downward flow of the reaction liquid may not occur smoothly. On the other hand, flow rates slower than the lower limit of the above range make the intermixing of the reaction liquid across each partition wall or plate excessive and cause back-mixing of the reaction liquid.

The pitch, in which the contents of β-resin components and quinoline-insoluble components have been increased owing to the polymerization reactions occurred in the lower reaction zone 6, is then removed from the system through a line 10.

According to the present invention, the content of β-resin components in the residual pitch to be obtained through the thermal cracking of heavy petroleum oil can be increased. The present invention also allows to design a column-like reactor relatively small in size. In the case of heavy petroleum oil, it is generally difficult to separate the gases produced from the heavy petroleum oil. This problem has been solved or at least lessened by the process according to this invention, wherein residual pitch contains little gas mixed and entrained therein and its discharge can be effected without trouble. This is an extremely important advantage for actual operation.

Now, the second aspect of this invention relates to the use of a cooling chamber and a defoaming chamber in the method for continuous thermal cracking method of heavy petroleum oil. Therefore, in the second aspect of this invention, there is provided a method whereby heavy petroleum oil which has been preheated to thermal cracking temperature is introduced continuously as a descending stream into the upper reaction zone of a column-like reactor, cracked gas and oil vapor are removed from the reactor through an upper portion thereof and residual pitch is discharged through a bottom portion of the reactor. The above method is characterized in that the resultant reaction liquid is introduced into a cooling chamber, which is contiguous to the lower most portion of the reactor and is separated therefrom by a foraminous partition plate interposed therebetween; a cooling medium, which comprises a substance nonreactive to the reaction liquid, is charged into the thus-introduced reaction liquid so that the reaction liquid is cooled making use of the sensible heat or latent heat of vaporization of the cooling medium to terminate the reaction; the resultant vapor of the cooling medium is discharged from the upper portion of the reactor; the reaction liquid in the cooling chamber is passed into a defoaming chamber, which adjoins the lowermost portion of the cooling chamber and separated therefrom by another partition wall or plate with openings therethrough to subject the reaction liquid to defoaming, after which the defoamed reaction liquid is removed from the defoaming chamber.

As the cooling medium, a nonreactive liquid may be employed having a boiling point lower than the reaction temperature such as water or a volatile oil or its vapor (of course, having a temperature lower than the reaction temperature). The resulting vapor of the cooling medium is allowed to rise together with gas bubbles separated in the defoaming chamber through the column-like reactor while being kept in contact with the reaction liquid.

It is necessary to use, as the column-like reactor, a cascade type reactor and particularly a column-like reactor which is divided into two superimposed reaction zones separated by means of a partition plate having openings therethrough, and the lower reaction zone being divided further into a plurality of regions or sections by one or more partition plates, each provided with openings therethrough, so as to allow a reaction liquid to travel downwardly without back-mixing.

The cooling chamber is preferably formed, as will be described later, integrally with the column-like reactor and defoaming chamber. If the reaction liquid, which has been cooled down in the cooling chamber, is mixed back in the hot reaction liquid in the column-like reactor, the temperature of the latter reaction liquid becomes lower and the thermal cracking reaction is thus suppressed. It is necessary that vapor, obtained from the cooling medium is charged to the cooling chamber, countercurrently to the flow of the reaction liquid. For this purpose, it is required to separate the reaction zone and cooling zone from each other by means of a foraminous partition plate.

It is also necessary, for separating satisfactorily the gas bubbles formed by the injection of the cooling medium, to provide underneath the cooling chamber a defoaming space area isolated from the cooling chamber by a partition plate similarly provided with openings therethrough, so as to minimize the influence of the reaction liquid in the cooling chamber and separate the gas bubbles sufficiently from the resultant residual pitch and eliminate vapor locks when removing the thus-cooled liquid pitch with a pump.

Another embodiment of this invention will now be described making reference to FIG. 3. Heavy petroleum oil is fed through a line 11 into a heating furnace 12, where it is preheated preferably to a temperature of 400°–510° C. Then, the thus-preheated heavy petroleum oil is introduced through a line 13 into an upper reaction zone 15 of a column-like reactor 14. A stirrer may be provided in the upper reaction zone 15. The resulting reaction liquid, which has undergone a major part of its thermal cracking reaction in the upper reaction zone 15, flows down through openings of a partition wall 17 into a lower reaction zone 16, which is divided into three sections by means of partition plates 17', 17''. The reaction liquid descends through the lower reaction zone 16 without back-mixing. No particular limitation exists to the number of these partition plates. The area of the openings formed through each partition plate is preferably 20% or less of the horizontal cross-sectional area of the column-like reactor, and more preferably, 10% or less. It is preferred to set the volume ratio of the upper reaction zone to the lower reaction zone of the column-like reactor at 0.5 or smaller.

Cracked gas and cracked oil vapor produced in the upper and lower reaction zones are withdrawn from the reactor through a line 18. On the other hand, the resultant reaction liquid in the lower reaction zone 16 descends through openings of a partition wall 19 into a cooling chamber 20 which is connected to the lowermost portion of the lower reaction zone 16. Into the cooling chamber 20, a cooling medium is charged through one or more feed nozzles 21. It is desirable to provide at least 4 feed nozzles 21 so that the cooling medium might be divided through the nozzles to ensure uniform cooling. It is also desirable to have a maximum possible flow rate of the cooling medium at the outlet of each feed nozzle. A preferred flow rate is 100 m/sec or more for gaseous cooling media and 2 m/sec or more for liquid cooling media. The objective of such a fast flow rate is to cause the cooling medium to penetrate sufficiently into the center of the cooling chamber and to avoid possible vibrations of the reaction liquid due to the injection of the cooling medium.

Where the cooling medium is liquid, it is desirable to preheat it to near its boiling point and then charge it into the cooling chamber. In the case of steam, its temperature must of course be lower than the temperature of the reaction liquid when it is injected. Normally, steam of 400° C. or lower is employed.

When the temperature of the reaction liquid is lowered to 360° C. or below by the cooling, the cracking reaction has practically been brought to a halt. It is however not recommendable to cool the reaction liquid beyond 300° C., as such a low temperature causes the viscosity of the resultant pitch to increase and makes its handling difficult.

The partition plate 19 is provided, similar to the partition plate 17, with circular openings or slits. The possibility of reverse mixing of the reaction liquid becomes less as the ratio of the total area of the openings to the horizontal cross-sectional area of the column-like reactor decreases. On the other hand, it is undesirable to have an excessive flow rate of the ascending gases because it impedes the smooth downward flow of the reaction liquid. According to the results of an investigation carried out by the present inventors, the above-mentioned mutually contradictory requirements can be satisfactorily fulfilled by making the total area of the openings 20% or less of the horizontal cross-sectional area of the lower reaction zone 16 and by selecting a gas flow rate at the openings of the partition plate 19 within a range of 1–10 m/sec. Any flow rate greater than the upper limit of the above range does not allow a smooth downward flow of the reaction liquid while any flow rate smaller than the lower limit of the above range results in excessive reverse mixing of the reaction liquid.

Vapors originated from the cooling medium charged in the cooling chamber 20, rise through the partition plate 19 and the column-shaped reactor 14 and are then removed together with cracked gas and cracked oil vapor through the line 18.

The reaction liquid in the cooling chamber 20 then descends through a partition plate 22 into a defoaming chamber 23. It is preferred not to effect any stirring or to effect only gentle stirring in the defoaming chamber 23 so that gas bubbles entrained in the pitch might be freed in sufficient amount. The partition plate 22 is provided to prevent the stirring in the cooling chamber 20 from exerting an influence upon the defoaming chamber 23. The total area of the openings of the partition plate 22 and the flow rate of the gases passing through the openings may be the same as those given above with respect to the partition plate 19.

Gas bubbles, which have been separated from the pitch, rise together with the vapor resulted from the cooling medium through the column-like reactor 14 and are then removed through the line 18.

Because of the defoaming chamber 20, it is possible to avoid the presence of gas bubbles in a dispersed state in the liquid pitch when this pitch is removed by a pump or the like via line 24.

The method according to the second embodiment of this invention is economical because a nonreactive cooling medium is charged directly into the hot reaction liquid, in which the cracking reaction has proceeded to a predetermined extent, and no heat-exchanging surfaces are thus required. The pitch furthermore is in no danger of coking. Since the vapors from the cooling medium rise through the column-like reactor, it is possible to drive off also the gases and oils dissolved in the pitch in the lower part of the reactor and to stabilize the pitch. Because of the defoaming treatment, the pumping-out of the pitch is facilitated.

Finally, the third embodiment of this invention, i.e. the use of a rotary scraper, will be described with reference to FIG. 4.

A heavy petroleum oil is preheated in a heating furnace (not illustrated) to a temperature of 450°–520° C. and then continuously fed through a line 31 into a column-like reactor 34. Within the reactor 34, there are provided foraminous partition plates 35, 35′, 35″. The reactor 34 may be provided with either a single partition plate or a plurality of partition plates. The heavy petroleum oil, fed through the line 31, is thermally cracked in the reactor 34, resulting in the formation of cracked gas and oil vapor which are removed through a line 32 from an upper portion of the reactor 34. On the other hand, the resultant pitch is removed through a line 33 from a lower part of the reactor 34.

Within the reactor 34, scraping blades 36, 36′, 36″, 36‴ are provided in their respective reactor sections defined by the partition plates 35, 35′, 35″. The blades are fixedly attached to a common drive shaft 38 with their edges positioned close to the reactor walls and to the upper and lower surfaces of their corresponding partition plates 35, 35′, 35″. The drive shaft 38 is rotated by drive means 39. Any coke which might be stuck on the inner wall of the reactor 34 is immediately scraped off while it is still in an easily removable condition and is dispersed in the pitch present in the reactor 34. The pitch with the thus-dispersed fine particles of the coke is then withdrawn as a suspension from the reactor 34 through the line 33.

Although it is desirable to make all clearances between the scraping blades 36, 36′, 36″, 36‴ and their adjoining stationary surfaces as narrow as possible, a clearance equivalent to 1% or less of the inner diameter of the reactor 34 is preferred from a practical viewpoint.

The circumferential speed of the scraping blades 36, 36′, 36″, 36‴ is preferably 3 cm/sec to 3 m/sec. Below 3 cm/sec, it is impossible to achieve a sufficient degree of mixing to disperse the stuck coke particles. Speeds exceeding 3 m/sec result in the wasting of power because the scraping effect is not proportional to the circumferential speed.

No specific limitation exists in the configurations of the scraping blades. It is of course necessary that they be of such configurations that coke stuck on the surfaces of each section of the reactor 34 might be efficiently and fully scraped off. It is also desirable to determine the size of each scraping blade so as to impart a gentle stirring to the whole liquid within its corresponding reactor section when rotated.

Coke may stick on the surface of the drive shaft 38 under certain conditions. To avoid the deposit of coke on the drive shaft 38, it is possible to provide fixed sleeves 37, 37', 37'', 37''', which surround the shaft 38 with a small clearance between it and all adjoining surfaces as shown in the drawing, whereby scattering and/or scraping off of any coke stuck on the surfaces of the fixed sleeves 37, 37', 37'', 37''' by means of their corresponding blades 36, 36', 36'', 36'''.

A thermal cracking reaction of heavy petroleum oil is accompanied by violent coking at places, where a liquid or gas flow becomes slack, for example, on the inner wall of a column-like reactor, and especially when the degree of cracking is considerably high. Stuck coke particles build up and harden due to their progressive carbonization. The principle feature of the third embodiment of this invention resides in that, in the cracking of heavy petroleum oil with a high degree of cracking, i.e., gas and light fractions of 30% by weight or more based on the feed of heavy petroleum oil, the sticking or deposit of coke particles and their build-up may be avoided and the coke particles may be continuously removed from the system while being dispersed in the pitch by continued stirring or mechanical scraping.

EXAMPLE 1

Figure 2:
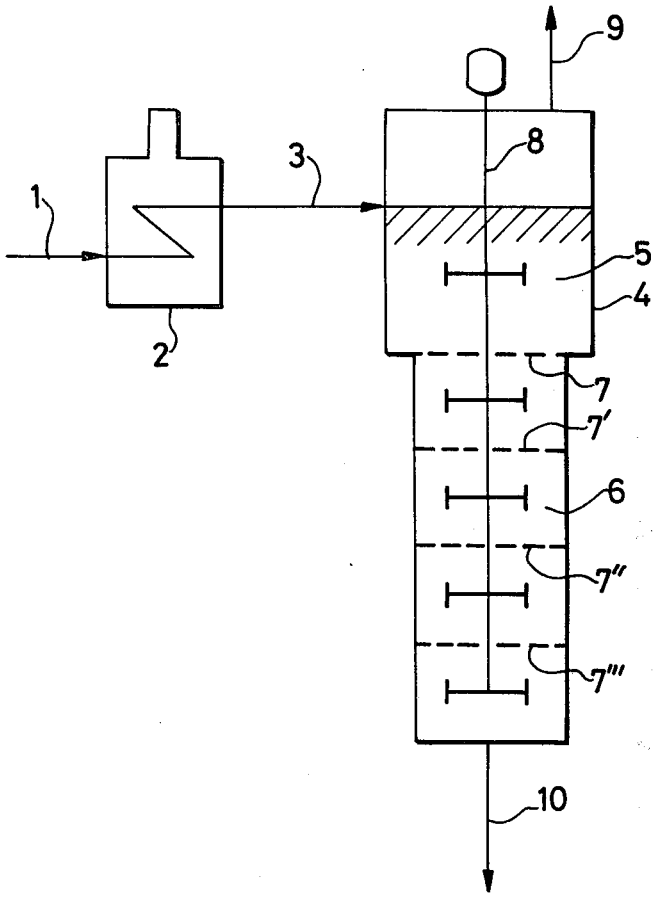
FIG. 2 is a schematic illustration of an upright cylindrical reactor used in a method according to this invention.

A reactor of the type as shown in FIG. 2 was employed. Its dimensions were as follows:

| | |
|---|---|
| Diameter of the upper reaction zone | 400 mm |
| Liquid depth in the upper reaction zone | 400 mm |
| Height of space area in the upper reaction zone | 400 mm |
| Diameter of the lower reaction zone | 300 mm |
| Height of the lower reaction zone | 950 mm |
| Number of partition plates (including the partition plate between the upper and lower reaction zones) | 6 |

Experiments were carried out in the above reactor with a residence time of 2 hours by using (based on the cross-sectional area of the reactor) partition plates of 3, 5, 10 and 20% respectively. In each experiment, reduced-pressure distillation residue of crude Kuwait oil was employed as feed. The preheating temperature, feeding flow rate and reaction pressure in the upper reaction zone were set, respectively at 490° C. 50 liters/hour and 1.5 atmospheres absolute. Other operation conditions and experiment results are shown in Table 1.

TABLE 1

| Experiment No. | 1 | 2 | 3 | 4 |
|---|---|---|---|---|
| Percentage of openings each partition wall or plate | 3 | 5 | 10 | 20 |
| Flow rate of gases passing through openings of the uppermost partition plate | 22.2* | 8 | 2 | 0.5 |

TABLE 1-continued

| Experiment No. | 1 | 2 | 3 | 4 |
|---|---|---|---|---|
| in the lower reaction zone (m/sec) | | | | |
| Temperature in the upper reaction zone (°C.) | — | 430 | 430 | 430 |
| Temperature at the lowermost part in the lower reaction zone (°C.) | — | 380 | 383 | 391 |
| Yield: | | | | |
| Cracked gas (wt. %) | — | 5.0 | 4.9 | 4.5 |
| Cracked oil (wt. %) | — | 60.0 | 59.1 | 56.5 |
| Pitch (wt. %) | — | 35.0 | 36.0 | 39.0 |
| Content of β-resin in pitch | — | 39 | 38.5 | 25 |
| | wt % | wt % | wt % | |

Note:
*unable to achieve a steady operation due to flooding of the reaction liquid.

As it is apparent from Table 1, when the flow rate of gases through the openings of a partition plate is high, say, 22.2 m/sec as in Experiment No. 1, the reaction liquid is not allowed to flow to the lower reaction zone and flooding occurs there, thereby making it impossible to maintain a steady state operation. Where the percentage of the openings in a partition plate is 20% as in Experiment No. 4, the content of β-resin in the resultant pitch is low, i.e., only 25% by weight.

EXAMPLE 2

Figure 3:
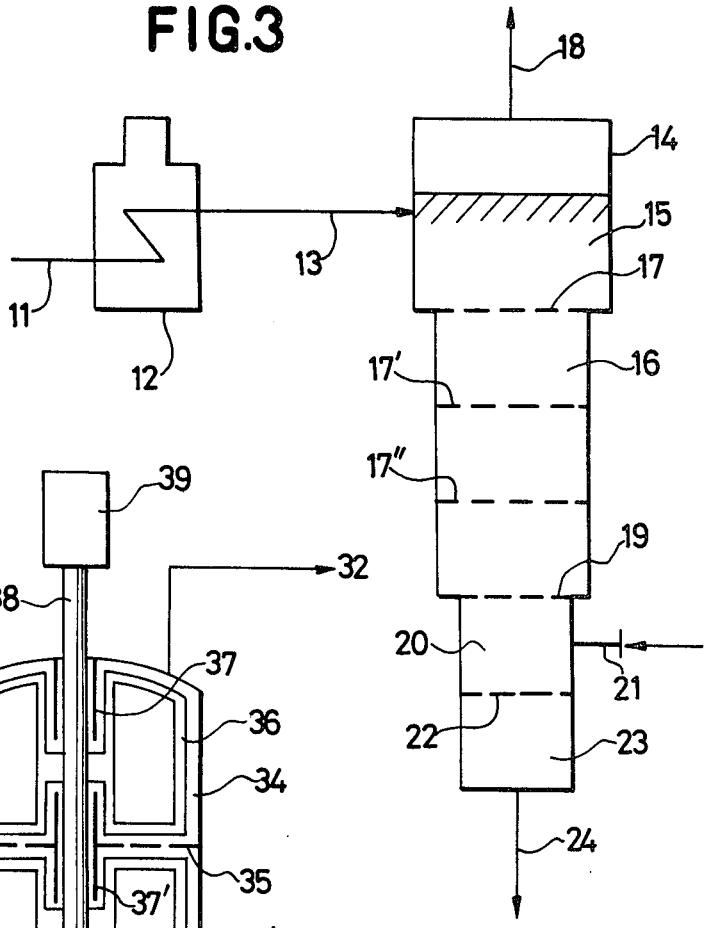
FIG. 3 depicts schematically a cooling chamber and a defoaming chamber provided at a lower portion of an upright cylindrical reactor.

A reactor of the type as illustrated in FIG. 3 was employed. Its diemnsions were as follows:

| | |
|---|---|
| Diameter of the upper reaction zone | 400 mm |
| Liquid depth in the upper reaction zone | 400 mm |
| Height of space area in the upper reaction zone | 400 mm |
| Diameter of the lower reaction zone | 300 mm |
| Height of the lower reaction zone | 950 mm |
| Percentage of the openings of partition wall or plate | 15% |
| Number of partition plates and walls | 6 |
| Spacing between each two partition plates and/or wall | 150 mm |

The residence time of reaction liquid in the reactor was set at 2 hours. Underneath the lowermost part of the reactor, was provided a cooling chamber of 250 mm in diameter and 200 mm in height which chamber was separated from the reactor by means of a partition plate having an opening of a single hole of 50 mm in diameter (percentage of the opening area: 2.8%). There was also provided underneath the cooling chamber and in direct communication therewith a defoaming chamber of 250 mm in diameter and 300 mm in height, which defoaming chamber was separated from the cooling chamber by a partition plate having a single hole of the same diameter, i.e., 50 mm.

50 Liters/hour of reduced-pressure distillation residue of crude Kuwait oil were preheated to 490° C. and then fed to the above column-like reactor maintained at a pressure of 1.5 atmospheres absolute. The temperature of the resultant pitch was 390° C. at the outlet of the lower reaction zone of the reactor. When no cooling medium was charged into the cooling chamber, it was impossible to remove the pitch from the lowermost part of the defoaming chamber by means of a centrifugal pump due to development of vapor lock. A steady discharge of the pitch was still difficult even after the centrifugal pump had been replaced by a gear pump.

Then, boiling water, which had been heated to 100° C., was charged at a flow rate of 800 grams/hour into the cooling chamber through 4 nozzles. The pitch was cooled in the cooling chamber to 350° C. The thus-cooled pitch was passed through the defoaming chamber and then removed from the lowermost part thereof by a small centrifugal pump. The pitch was discharged extremely readily and continuously.

EXAMPLE 3

Reduced-pressure distillation residue of crude Kuwait oil was fed, subsequent to being preheated to 500° C., at a flow rate of 50 liters/hour into the upper part of a column-like reactor of 400 mm in diameter and 1,200 mm in height and containing 6 partition plates with a plurality of openings (percentage of the total opening area: 5%). The oil was subjected to a thermal cracking reaction at 1.5 atmospheric absolute and resultant gas and oil vapors were removed from the top of the reactor while the pitch was discharged from the bottom of the reactor by a pump. When the operation reached a steady state, the upper and lower reaction temperatures reached, respectively, 450° C. and 380° C. The yields of gas and oil were, respectively, 6% by weight and 65% by weight of the feed, and that of pitch was 29% by weight.

When the operation was continued in the above state, the steady state was maintained for 100 hours. Thereafter, the yields of gas and oil dropped gradually and that of pitch increased. The temperature at the lower outlet increased and, the residence time seemed, on the surface, to diminish. The operation was forced to a halt 250 hours later.

Figure 4:
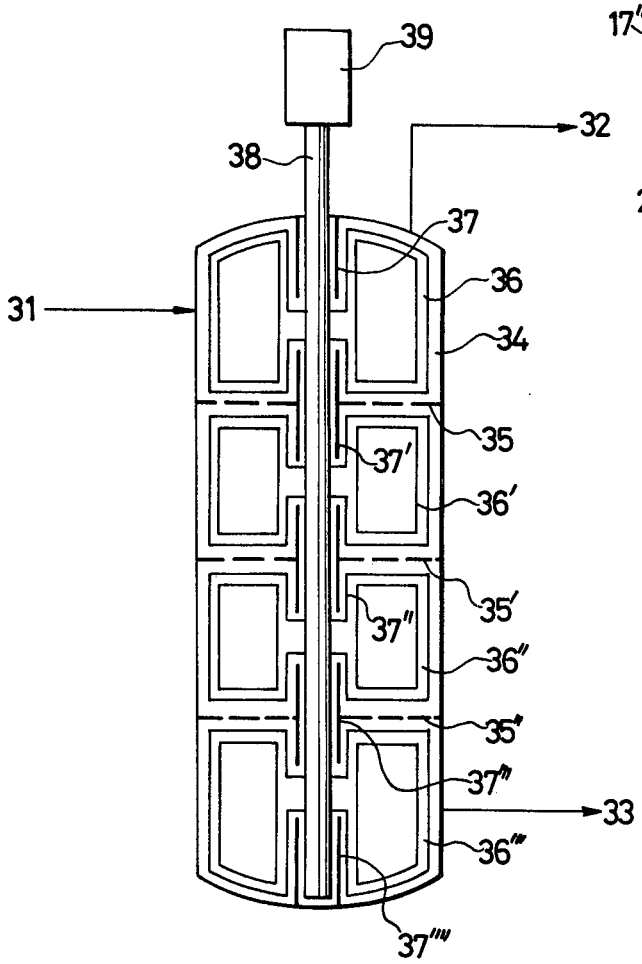
FIG. 4 shows schematically a rotary scraper provided in an upright cylindrical reactor.

Then, a cracking operation was carried out under the same conditions by providing the same reactor with scraping blades as shown in FIG. 4. The clearance between each blade edge and its corresponding reactor inner wall or partition plate surface was set at 3 mm. The scraping blades were rotated at 30 cm/sec at their peripheries. Each scraping blade had flat-plate like configurations of 20 mm in width. Even after the lapse of 2,000 hours subsequent to the attainment of a steady state operation, no changes occurred and the operation was allowed to continue in the steady state. It was confirmed that the resultant removed pitch contained only meso-phase coke which is a precursor of coke. The meso-phase coke was scattered throughout the pitch in the form of very fine particles. It was thus confirmed that the thus-produced pitch did not contain any coke agglomerates.

As it is apparent from the above description, the method according to the third embodiment of this invention assures a much longer, steady, continuous operation as compared with the case where no scraping blades are provided.

What is claimed is:

1. In a method for the continuous thermal cracking of heavy petroleum oil, the iprovement which comprises the steps of:

(a) continuously charging a pre-heated petroleum oil feed into the upper reaction zone of an upright cylindrical reactor, said reactor having upper and lower reaction zones separated from each other by foraminous partition plate, said lower zone having at least one section;

(b) subjecting said feed to a thermal cracking reaction at cracking temperatures and pressures;

(c) removing cracked gas and oil vapors from said upper reaction zone;

(d) simultaneously passing the resultant reaction liquid from said upper reaction zone to and through said lower reaction zone without back-mixing;

(e) passing any additional cracked gas and oil vapor formed in said lower reaction zone upwardly through the reactor and removing them from said upper reaction zone; and (f) discharging residual pitch formed in said lower reaction zone from the bottom of said lower reaction zone.

2. The method claimed in claim 1, wherein the temperature in said reactor is maintained within the range of 400°–510° C.

3. The method claimed in claim 1, wherein the pressure in said reactor is maintained within the range of 1–20 atmospheres absolute.

4. The method claimed in claim 1, wherein said lower reaction zone consists of a plurality of superimposed sections separated from one another by partition plates.

5. The method claimed in claim 4, wherein said lower reaction zone contains from 1 to 20 partition plates.

6. The method claimed in claim 1, further comprising the steps of:

(g) introducing the resultant reaction liquid from step (d) into a cooling chamber positioned contiguous to and beneath said lower reaction zone and separated therefrom by a foraminous partition plate, while charging a non-reactive cooling medium into said cooling chamber to contact and cool said reaction liquid, thus terminating the cracking reaction;

(h) passing vaporized cooling medium to said upper reaction zone and removing it therefrom;

(i) passing said liquid from said cooling chamber into a defoaming chamber positioned beneath said cooling chamber and separated therefrom by a foraminous partition plate and subjecting said reaction liquid to a defoaming action.

7. The method claimed in claim 6, wherein said non-reactive cooling medium has a boiling point lower than the reaction temperature and is selected from the group consisting of water, volatile oils and vapors thereof.

* * * * *